US005141407A

United States Patent [19]

Ramsey et al.

[11] Patent Number: 5,141,407

[45] Date of Patent: Aug. 25, 1992

[54] SCROLL MACHINE WITH OVERHEATING PROTECTION

[75] Inventors: Jeffery D. Ramsey; Jean-Luc Caillat, both of Dayton; Sunil S. Kulkarni, Fairborn, all of Ohio

[73] Assignee: Copeland Corporation, Sidney, Ohio

[21] Appl. No.: 591,428

[22] Filed: Oct. 1, 1990

[51] Int. Cl.[5] ..... F04B 21/02

[52] U.S. Cl. ..... 417/292; 62/196.3

[58] Field of Search ..... 417/32, 292; 62/196.3

[56] References Cited

U.S. PATENT DOCUMENTS

| | | | |
|---|---|---|---|
| D. 218,792 | 9/1986 | Fujio | 417/292 |
| 4,383,805 | 5/1983 | Teegarden et al. . | |
| 4,456,435 | 6/1984 | Hiraga et al. . | |
| 4,496,296 | 1/1985 | Arai et al. . | |
| 4,505,651 | 3/1985 | Terauchi et al. . | |
| 4,514,150 | 4/1985 | Hiraga et al. . | |
| 4,560,330 | 12/1985 | Murayame et al. . | |
| 4,586,653 | 5/1986 | Föller et al. | 236/48 R |
| 4,596,520 | 6/1986 | Arata et al. . | |
| 4,596,521 | 6/1986 | Murayama et al. . | |
| 4,669,962 | 6/1987 | Mizuno et al. . | |
| 4,714,415 | 12/1987 | Mizuno et al. . | |
| 4,744,733 | 5/1988 | Teramehi et al. . | |
| 4,840,545 | 6/1989 | Moilanen . | |
| 4,846,633 | 7/1989 | Suzuki et al. . | |

FOREIGN PATENT DOCUMENTS

| | | |
|---|---|---|
| 57-110789 | 7/1982 | Japan . |
| 59-119080 | 7/1984 | Japan . |
| 60-75796 | 4/1985 | Japan . |
| 60-66892 | 5/1985 | Japan . |
| 60-78997 | 6/1985 | Japan . |
| 60-243388 | 12/1985 | Japan . |
| 61-17490 | 1/1986 | Japan . |
| 61-87988 | 5/1986 | Japan . |
| 61-89990 | 5/1986 | Japan . |
| 61-144284 | 9/1986 | Japan . |
| 61-145892 | 9/1986 | Japan . |
| 63-134894 | 6/1988 | Japan . |

*Primary Examiner*—Richard A. Bertsch
*Assistant Examiner*—David W. Scheuermann
*Attorney, Agent, or Firm*—Harness, Dickey & Pierce

[57] ABSTRACT

A thermally responsive valve arrangement for scroll motor-compressor high temperature protection, which causes a high-side to low-side leak when excessive discharge gas temperatures are encountered, thereby causing the motor protector to trip and deenergize to motor. A unique valve per se is also disclosed.

22 Claims, 3 Drawing Sheets

FIG. 3.
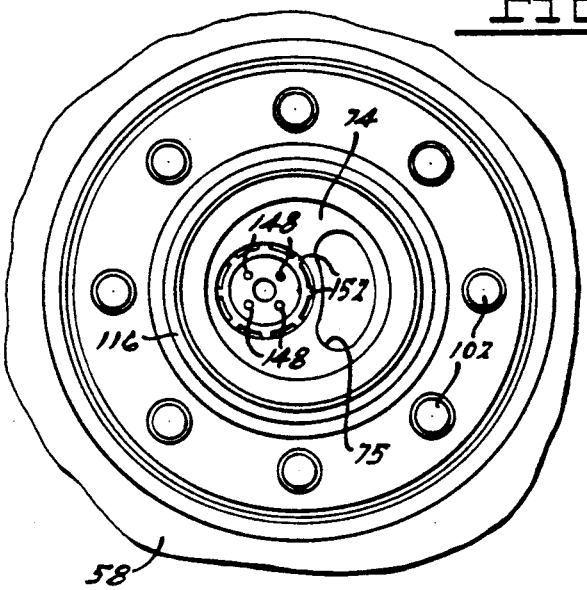
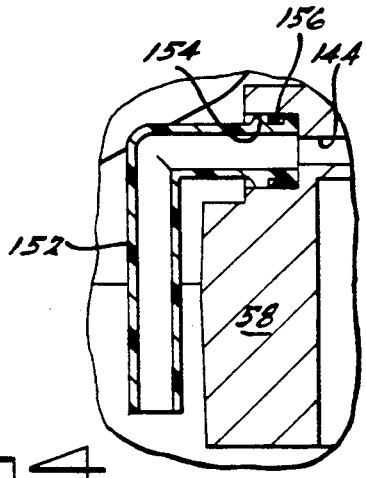
FIG. 4.
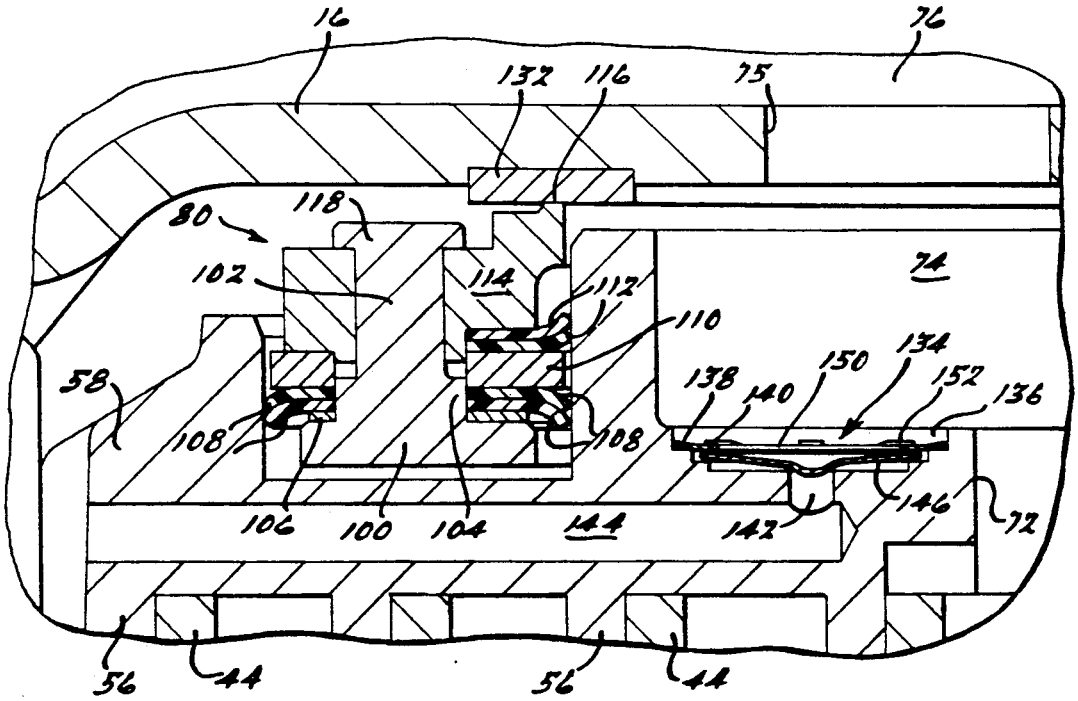
FIG. 2.

SCROLL MACHINE WITH OVERHEATING PROTECTION

The present invention relates to scroll-type machinery, and more particularly to scroll compressors having unique means for protecting the machine from overheating.

BACKGROUND AND SUMMARY OF THE INVENTION

A typical scroll machine has an orbiting scroll member having a spiral wrap on one face thereof, a non-orbiting scroll member having a spiral wrap on one face thereof with said wraps being entermeshed with one another, ad means for causing said orbiting scroll member to orbit about an axis with respect to said non-orbiting scroll member, whereby said wraps will create pockets of progressively decreasing volume from a suction zone to a discharge zone.

It has been discovered that one of the unique features of scroll machines is that excessive high temperature discharge gas conditions (which result from the high pressure ratios caused by many different field-encountered problems) can be solved by providing means to cause a high-side to low-side leak during these conditions.

It is therefore one of the primary objects of the present invention to provide an improved mode of temperature protection which is extremely simple in construction, utilizing a simple temperature responsive valve, and which is easy to install and inspect, and which effectively provides the control desired. The valve of the present invention has been discovered to be particularly good at providing pressure ratio and hence high temperature protection, particularly in motor-compressors where suction gas is used to cool the motor. This is because the valve will create a leak from the high side to the low side at discharge temperatures which are significantly higher than those for which the machine was designed. This leakage of discharge fluid to the suction side of the compressor essentially causes the machine to cease any significant pumping, and the resulting heat build-up within the compressor enclosure and lack of flow of relatively cool suction gas will cause the standard motor protector to trip and shut the machine down. The present invention therefore provides protection from excessive discharge temperatures which could result from (a) loss of working fluid charge, or (b) a blocked condensor fan in a refrigeration system, or (c) a low pressure condition or a blocked suction condition or (d) an excess discharge pressure condition for any reason whatever. All of these undesirable conditions will cause a scroll machine to function at a pressure ratio much greater than that which is designed into the machine in terms of its predetermined fixed volume ratio, and this will in turn cause excessive discharge temperatures.

These and other objects and advantages will become more apparent when viewed in light of the accompanying drawings and following detailed description.

BRIEF DESCRIPTION OF THE DRAWING FIGURES

FIG. 2 is an enlarged vertical sectional view of a thermally responsive valve forming a part of the invention and shown in its normally closed state;

FIG. 3 is a top plan view of the apparatus of FIG. 2;

FIG. 4 is a fragmentary view similar to FIG. 2 showing a possible modification of the apparatus of the present invention;

DETAILED DESCRIPTION OF THE PREFERRED EMBODIMENTS

Figure 1:
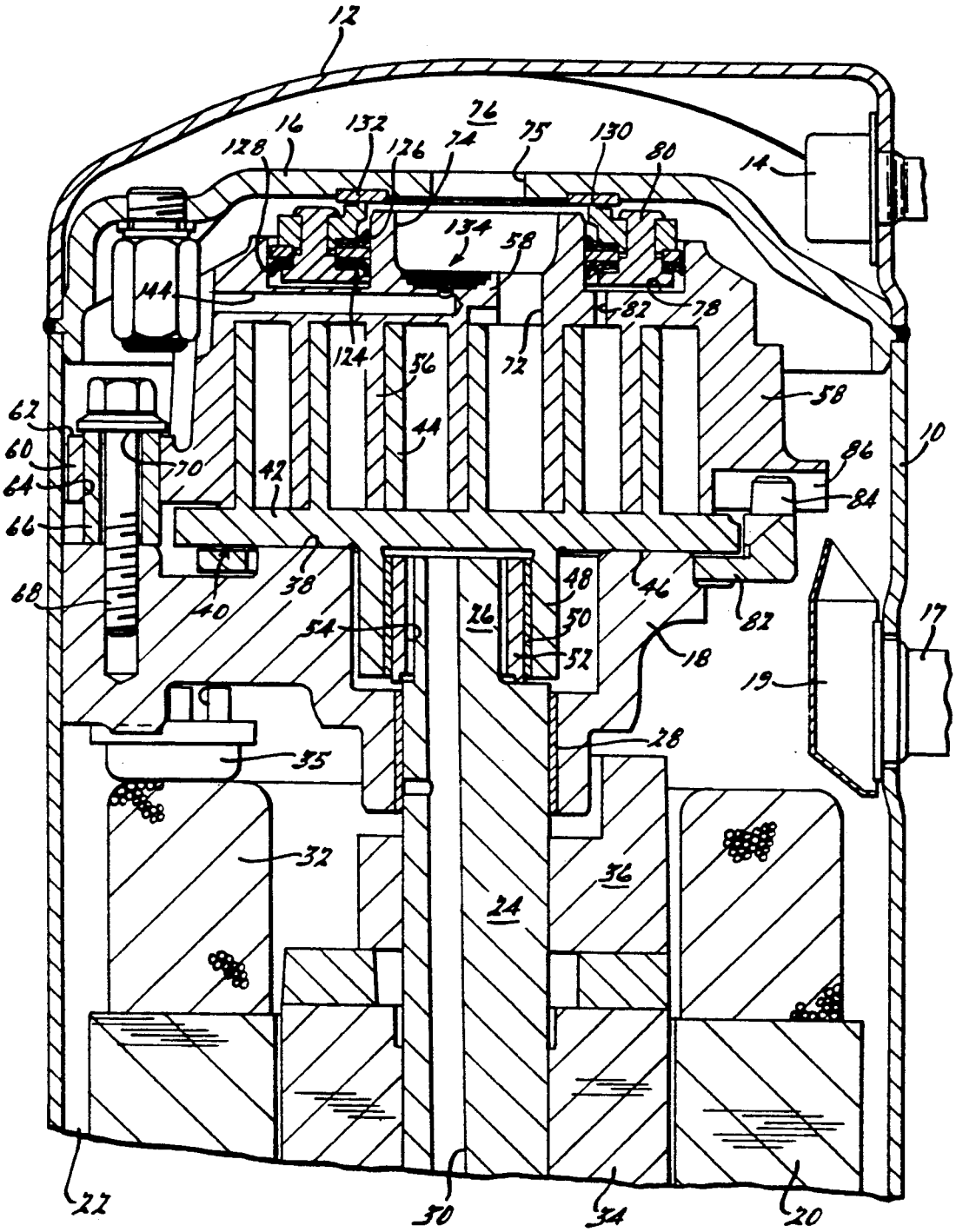
FIG. 1 is a partial vertical sectional view through a scroll machine embodying the principles of the present invention.

While the present invention is suitable for incorporation in many different types of scroll machines for exemplary purposes it will be described herein incorporated in a hermetic scroll refrigerant motor-compressor of the "low side" type (i e . where the motor and compressor are cooled by suction gas in the hermetic shell, as illustrated in vertical section in FIG. 1). Generally speaking, the compressor comprises a cylindrical hermetic shell 10 having welded at the upper end thereof a cap 12, which is provided with a refrigerant discharge fitting 14 optionally having the usual discharge valve therein (not shown). Other elements affixed to the shell include a transversely extending partition 16 which is welded about its periphery at the same point that cap 12 is welded to shell 10, a main bearing housing 18 which is affixed to shell 10 at a plurality of points in any desirable manner, and a suction gas inlet fitting 17 having a gas deflector 19 disposed in communication therewith inside the shell.

A motor stator 20 which is generally square in cross-section but with the corners rounded off is press fit into shell 10. The flats between the rounded corners on the stator provide passageways between the stator and shell, indicated at 22. which facilitate the flow of lubricant from the top of the shell to the bottom. A crankshaft 24 having an eccentric crank pin 26 at the upper end thereof is rotatably journaled in a bearing 28 in main bearing housing 18 and a second bearing 42 in a lower bearing housing (not shown). Crankshaft 24 has at the lower end the usual relatively large diameter oil-pumping concentric bore (not shown) which communicates with a radially outwardly inclined smaller diameter bore 30 extending upwardly therefrom to the top of the crankshaft. The lower portion of the interior shell 10 is filled with lubricating oil in the usual manner and the pump at the bottom of the crankshaft is the primary pump acting in conjunction with bore 30, which acts as a secondary pump to pump lubricating fluid to all the various portions of the compressor which require lubrication.

Crankshaft 24 is rotatively driven by an electric motor including stator 20, windings 32 passing therethrough, and a rotor 34 press fit on the crankshaft and having one or more counterweights 36 A motor protector 35, of the usual type, is provided in close proximity to motor windings 32 so that if the motor exceeds its normal temperature range the protector will deenergize the motor.

The upper surface of main bearing housing 18 is provided with an annular flat thrust bearing surface 38 on which is disposed an orbiting scroll member 40 comprising an end plate 42 having the usual spiral vane or wrap 44 on the upper surface thereof, an annular flat thrust surface 46 on the lower surface, and projecting downwardly therefrom a cylindrical hub 48 having a journal bearing 50 therein and in which is rotatively disposed a drive bushing 52 having an inner bore 54 in which crank pin 26 is drivingly disposed. Crank pin 26 has a flat on one surface (not shown) which drivingly engages a flat surface in a portion of bore 54 (not shown) to provide a radially compliant driving arrangement, such as shown in assignee's U.S. Pat. No. 4,877,382, the disclosure of which is herein incorporated by reference.

Wrap 44 meshes with a non-orbiting spiral wrap 56 forming a part of non-orbiting scroll member 58 which is mounted to main bearing housing 18 in any desired manner which will provide limited axial movement of scroll member 58. The specific manner of such mounting is not relevant to the present inventions, however, in the present embodiment for exemplary purposes, non-orbiting scroll member 58 has a plurality of circumferentially spaced mounting bosses 60, one of which is shown, each having a flat upper surface 62 and an axial bore 64 in which is slidably disposed a sleeve 66 which is bolted to main bearing housing 18 by a bolt 68 in the manner shown Bolt 68 has an enlarged head having a flat lower surface 70 which engages surface 62 to limit the axially upper or separating movement of non-orbiting scroll member, movement in the opposite direction being limited by axial engagement of the lower tip surface of wrap 56 and the flat upper surface of orbiting scroll member 40. For a more detailed description of the non-orbiting scroll suspension system, see applicants' assignee's copending application entitled Non-Orbiting Scroll Mounting Arrangement For A Scroll Machine, and filed of even date the disclosure of which is hereby incorporated herein by reference.

Non-orbiting scroll member 58 has a centrally disposed discharge passageway 72 communicating with an upwardly open recess 74 which is in fluid communication via an opening 75 in partition 16 with the discharge muffler chamber 76 defined by cap 12 and partition 16. Non-orbiting scroll member 58 has in the upper surface thereof an annular recess 78 having parallel coaxial side walls in which is sealingly disposed for relative axial movement an annular floating seal 80 which serves to isolate the bottom of recess 78 from the presence of gas under suction and discharge pressure so that it can be placed in fluid communication with a source of intermediate fluid pressure by means of a passageway 81. The non-orbiting scroll member is thus axially biased against the orbiting scroll member by the forces created by discharge pressure acting on the central portion of scroll member 58 and those created by intermediate fluid pressure acting on the bottom of recess 78. This axial pressure biasing, as well as various techniques for supporting scroll member 58 for limited axial movement are disclosed in much greater detail in assignee's aforesaid U.S. Pat. No. 4,877,328.

Relative rotation of the scroll members is prevented by the usual Oldham coupling comprising a ring 82 having a first pair of keys 84 (one of which is shown) slidably disposed in diametrically opposed slots 86 (one of which is shown) in scroll member 38 and a second pair of keys (not shown) slidably disposed in diametrically opposed slots 108 in scroll member 40.

Although the details of construction of floating seal 80 are not part of the present invention, for examplary purposes seal 80 is of a coaxial sandwiched construction and comprises an annular base plate 100 having a plurality of equally spaced upstanding integral projections 102 each having an enlarged base portion 104. Disposed on plate 100 is an annular gasket 106 having a plurality of equally spaced holes which receive base portions 104, on top of which is disposed a pair of normally flat identical lower lip seals 108 formed of glass filled PTFE. Seals 108 have a plurality of equally spaced holes which receive base portions 104. On top of seals 108 is disposed an annular spacer plate 110 having a plurality of equally spaced holes which receive base portions 104, and on top of plate 110 are a pair of normally flat identical annular upper lip seals 112 formed of a same material as lip seals 108 and maintained in coaxial position by means of an annular upper seal plate 114 having a plurality of equally spaced holes receiving projections 102. Seal plate 114 has disposed about the inner periphery thereof an upwardly projecting planar sealing lip 116. The assembly is secured together by swaging the ends of each of the projections 102 as indicated at 118.

The overall seal assembly therefor provides three distinct seals; namely, an inside diameter seal at 124 and 126, an outside diameter seal at 128 and a top seal at 130 as best seen in FIG. 1. Seal 124 is between the inner periphery of lip seals 108 and the inside wall of recess 78, and seal 126 is between the inner periphery of lip seals 112 and the inside wall of recess 78. Seals 124 and 126 isolate fluid under intermediate pressure in the bottom of recess 78 from fluid under discharge pressure in recess 74. Seal 128 is between the outer periphery of lip seals 108 and the outer wall of recess 78, and isolates fluid under intermediate pressure in the bottom of recess 78 from fluid at suction pressure within shell 10. Seal 130 is between lip seal 116 and an annular wear ring 132 surrounding opening 75 in partition 16, and isolates fluid at suction pressure from fluid at discharge pressure across the top of the seal assembly. The details of construction of seal 80 are more fully described in applicants' assignee's copending application for U.S. Letters patent, Ser. No. 591,454, filed of even date and entitled Scroll With Floating Seal, the disclosure of which hereby incorporated herein by reference.

The compressor is preferably of the "low side" type in which suction gas entering via deflector 19 is allowed, in part, to escape into the shell and assist in cooling the motor. So long as there is an adequate flow of returning suction gas the motor will remain within desired temperature limits. When this flow drops significantly, however, the loss of cooling will cause motor protector 35 to trip and shut the machine down.

The scroll compressor as thus far broadly described is either now known in the art or is the subject matter of other pending applications for patent by applicants' assignee. The details of construction which incorporate the principles of the present invention are those which deal with a unique temperature responsive valve assembly, indicated generally at 134, which causes the compressor to cease any significant pumping if the discharge gas reaches excessive temperatures, thereby depriving the motor of its normal flow of cooling gas, which causes the standard motor protector to deenergize the motor.

The temperature responsive valve assembly 134 of the first embodiment of the present invention, best seen in FIGS. 1-3, comprises a circular valve cavity 136 disposed in the bottom of recess 74 and having annular coaxial peripheral steps 138 and 140 of decreasing diameter respectively. The bottom of recess 74 communicates with an axial passage 142 of circular cross-section which in turn communicates with a radial passage 144, the radially outer outlet end of which is in communication with suction gas within shell 10. The intersection of passage 142 and the planar bottom of cavity 136 defines a circular valve seat, in which is normally disposed the spherical center valving portion of a circular slightly spherical relatively thin saucer-like bitmetallic valve 146 having a plurality of through holes 148 disposed outwardly of the spherical valving portion.

Valve 146 is retained in place by a circular generally annular spider-like retainer ring 150 which has an open center portion and a plurality of spaced radially outwardly extending fingers 152 which are normally of a slightly larger diameter than the side wall of cavity 136. After valve 146 is assembled in place, retainer 150 is pushed into cavity 136 until it bottoms out on step 138, and is held in place by fingers 152 which bitingly engage the side wall of cavity 136. In FIG. 2 valve 146 is shown in its normally closed position (i.e., slightly concave downwardly) with its peripheral rim disposed between retainer 150 and step 140 and its center valving portion closing passageway 142.

Being disposed in discharge gas recess 74 valve 146 is fully exposed to the temperature of the discharge gas very close to the point it exits the scroll wraps (obviously the closer the temperature sensed is to the actual temperature of the discharge gas in the last scroll compression pocket the more accurately the machine will be controlled in response to discharge pressure). The materials of bimetallic valve 146 are chosen, using conventional criteria so that when discharge gas temperature reaches a predetermined value which is considered excessive, the valve will "snap" into its open position in which it is slightly concave upwardly with its outer periphery engaging step 140 and its center valving portion elevated away from the valve seat. In this position high pressure discharge fluid can leak through holes 148 and passages 142 and 144 to the interior of the shell, which is at suction pressure. This leakage causes the compressor to substantially quit pumping as a consequence of which the motor loses its flow of cooling medium, i.e., the inlet flow of relatively cool suction gas. The motor therefore heats up and trips its protector 35 thus shutting down the compressor.

FIG. 4 shows a possible modification wherein an L-shaped plastic extension tube 152 is inserted into a counterbore 154 in passage 144, using an elastomeric seal 156 to carry bypass or "leaked" gas from passage 144 downwardly past the suction zone of the compressor and even closer to the motor space thereby reducing undesirable excessive heating of the suction gas and thereby increasing motor temperature. Although it is intended to let the motor heat up so that protector will trip, it is not good to let the suction gas and hence discharge gas to get any hotter than they already are at this point. Overly excessive discharge temperatures will destroy the lubricant and damage the compressor.

Figure 6:
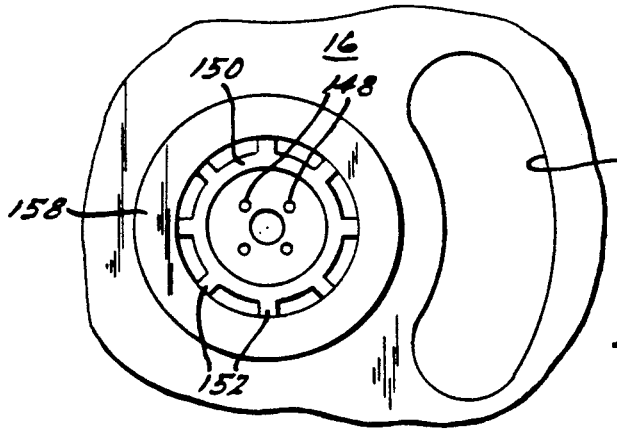
FIG. 6 is a top plan view of the embodiment of FIG. 5.
Figure 5:
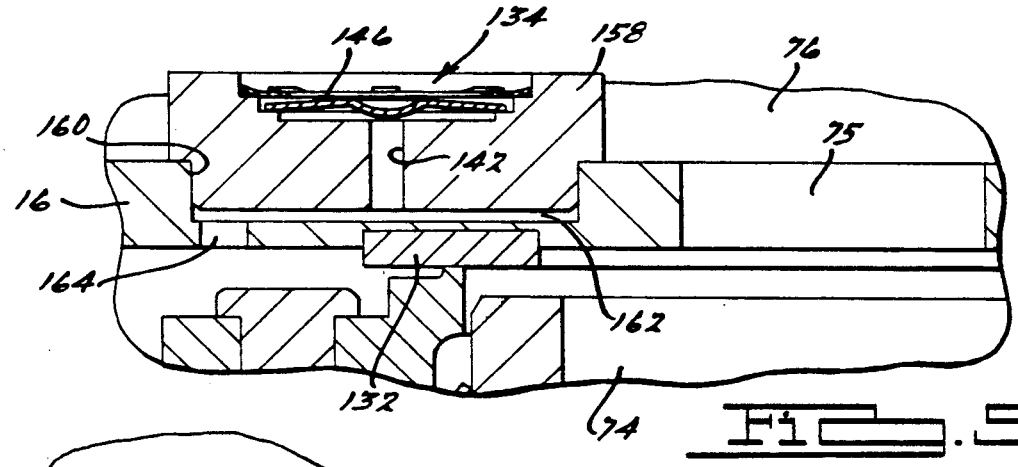
FIG. 5 is an enlarged vertical section view of a second embodiment of the present invention showing the thermally responsive valve in its normally closed state.

In the embodiment of FIGS. 5 and 6 valve assembly 134 is located on partition 16 rather than in recess 74 where there could be serious space constraints in certain compressor designs. Here valve assembly 134 is mounted in a fitting 158 which is secured to partition 16 in a fluid bore 160 in any suitable manner, with the bottom of fitting 158 being spaced slightly from the bottom of bore 160 to define a cavity 162. The top of the valve assembly is exposed to discharge gas in discharge muffler 76, and when excessive temperatures are encountered valve 146 opens to permit leaking from the discharge muffler through the valve into cavity 162 via passage 142. From there, the leaking gas flows through an axial passage 164 disposed outside wear ring 132 into the interior of shell 10. This embodiment otherwise functions in exactly the same way as the embodiment of FIGS. 1-3.

Figure 8:
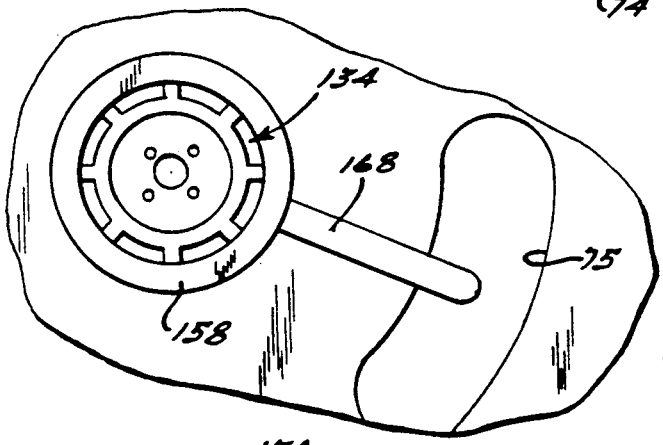
FIG. 8 is a top plan view of the embodiment of FIG. 7
Figure 7:
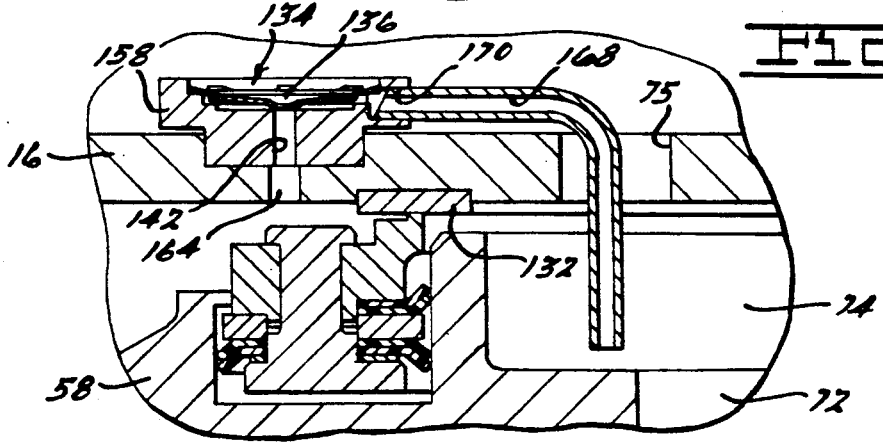
FIG. 7 is an enlarged vertical sectional view of a third embodiment of the present invention.

The embodiment of FIGS. 7 and 8 is essentially the same in design and function as the embodiment of FIGS. 5 and 6 except that there is provided an L-shaped tube 168 having one end disposed in a bore 170 in fitting 158, which communicates with valve cavity 136 and the opposite end disposed immediately adjacent discharge port 72, for the purpose of making the valve more sensitive to temperatures closer to the compressing mechanism. The closer the temperature sensed is to the actual compressor discharge gas temperature the more accurate and reliable is the control.

While this invention has been described in connection with these particular examples, no limitation is intended except as defined by the following claims. The skilled practitioner will realize that other modifications may be made without departing from the spirit of this invention after studying the specification and drawings.

We claim:

1. A scroll compressor comprising:

(a) an hermetic shell;

(b) a first scroll member disposed in said shell and having a first spiral wrap on one face thereof;

(c) a second scroll member disposed in said shell and having a second spiral wrap on one face thereof, said wraps being extermeshed with one another;

(d) a motor in said shell for causing said first scroll member to orbit with respect to said second scroll member whereby said wraps will create pockets of progressively decreasing volume from a suction zone at suction pressure to a discharge zone at discharge pressure;

(e) means for introducing suction gas into said shell, said suction gas providing cooling for said motor;

(f) passage means defining a passageway in fluid communication at one end with a sensing zone of compressed gas from said compressor which is at a pressure higher than said suction pressure and at the other end with said suction zone; and (g) normally closed thermally responsive valve means in said passage means for controlling gas flow therethrough, said valve operating in response to a sensed gas temperature in said sensing zone in excess of a predetermined value to open said passage means and thereby permit the leakage of compressed gas from said sensing zone to said suction zone.

2. A scroll compressor as claimed in claim 1 further comprising a thermal protector on said motor for deenergizing said motor when it reaches a predetermined excessive temperature, and wherein said leakage causes a significant decrease in compressing action which in turn reduces the cooling flow of suction gas across said motor, thereby causing said thermal protector to trip and deenergize said motor.

3. A scroll compressor as claimed in claim 2 wherein the outlet of said passage means is in the vicinity of the motor space.

4. A scroll compressor as claimed in claim 3 wherein said passage means is in said second scroll and extends radially to the outer periphery thereof.

5. A scroll compressor as claimed in claim 4 further comprising tubular means having an inlet in fluid communication with the outlet of said passage means and having an outlet in the motor space.

6. A scroll compressor as claimed in claim 1 wherein said valve means comprises a bimetalic valve element.

7. A scroll compressor as claimed in claim 6 wherein said valve element is circular disk-like in configuration and has a generally spherical central valve portion, said passage means including an annular shoulder which functions as a valve seal engageable by said spherical valve portion.

8. A scroll compressor as claimed in claim 7 wherein valve means is maintained in a normally closed position by the pressure differential thereacross.

9. A scroll compressor as claimed in claim 7 wherein said valve element has a plurality of holes therethrough spaced from said valve portion for permitting the flow of gas therethrough when open.

10. A scroll compressor as claimed in claim 1 further comprising means defining a discharge passage through said second scroll member through which compressed gas exits said pockets at the end of each compression cycle, said valve means being disposed in a valve cavity in the wall of said discharge passage.

11. A scroll compressor as claimed in claim 10 wherein said discharge passage comprises a relatively small diameter first axial bore for receiving discharge gas from said pockets and a relatively large diameter second axial bore receiving discharge gas from said first bore, said cavity being in said second bore in the vicinity of the outlet of said first bore.

12. A scroll compressor as claimed in claim 11 wherein said second bore has a relatively flat transverse axially inner surface with said first bore extending from said surface, said valve cavity being disposed in said surface.

13. A scroll compressor as claimed in claim 1 wherein the gas in said sensing zone is at discharge pressure.

14. A scroll compressor comprising:

(a) an hermetic shell;

(b) a first scroll member disposed in said shell and having a first spiral wrap on one face thereof;

(c) a second scroll member disposed in said shell and having a second spiral wrap on one face thereof, said wraps being entermeshed with one another;

(d) a motor in said shell for causing said first scroll member to orbit with respect to said second scroll member whereby said wraps will create pockets of progressively decreasing volume from a suction zone at suction pressure to a discharge zone at discharge pressure;

(e) a partition across said shell defining a discharge gas muffler;

(f) a discharge gas passage extending from said discharge zone to said discharge gas muffler;

(g) means for introduction suction gas into asid shell, said suction gas providing cooling for said motor;

(h) passage means defining a passageway extending from said discharge gas muffler to said suction zone; and (i) normally closed thermally responsive valve means in said passage means for controlling gas flow therethrough, said valve operating in response to a sensed gas temperature in said discharge gas muffler in excess of a predetermined value to open said passage means and thereby permit the leakage of compressed gas from said discharge gas muffler to said suction zone.

15. A scroll compressor as claimed in claim 14 further comprising a thermal protector on said motor for deenergizing said motor when it reaches a predetermined excessive temperature and wherein said leakage causes a significant decrease in compressing action which in turn reduces the cooling flow of suction gas across said motor, thereby causing said thermal protector to trip and deenergize said motor.

16. A scroll compressor as claimed in claim 15 wherein the outlet of said passage means is in the vicinity the motor space.

17. A scroll compressor as claimed in claim 16 wherein said valve means is in said partition.

18. A scroll compressor as claimed in claim 14 wherein said valve means comprises a bimetalic valve element.

19. A scroll compressor as claimed in claim 18 wherein said valve element is circular disk like in configuration and has a generally spherical central valve portion, said passage means including an annular shoulder which functions as a valve seal engageable by said spherical valve portion.

20. A scroll compressor as claimed in claim 19 wherein valve means is maintained in a normally closed position by the pressure differential thereacross.

21. A scroll compressor as claimed in claim 14 further comprising a tubular member extending from the upstream side of said valve means through at least a portion of said discharge gas passage to a point closer to where said gas exits said scroll pockets, thereby enabling said valve means to respond more directly to actual discharge gas pressure.

22. A scroll compressor as claimed in claim 14 wherein said valve means comprises:

(a) a body defining a cavity having a centrally disposed valve seat; and (b) a disk-like valve element formed of bimetallic material, said element having a slightly spherical peripheral portion concave in one direction and an integral central projection constituting a valving portion engageable with said valve seat.

* * * * *

UNITED STATES PATENT AND TRADEMARK OFFICE

CERTIFICATE OF CORRECTION

PATENT NO. : 5,141,407

DATED : August 25, 1992

INVENTOR(S) : Jeffery D. Ramsey; Jean-Luc Caillat; Sunil S. Kulkarni

It is certified that error appears in the above-identified patent and that said Letters Patent is hereby corrected as shown below:

Abstract, line 5, "to" (second occurrence) should be — the —.

Column 1, line 15, "entermeshed" should be — intermeshed —.

Column 1, line 16, "ad" should be — and —.

Column 2, line 16, after "7" insert — . —.

Column 2, line 24, "i e ." should be — i.e., —.

Column 3, line 28, after "shown" insert — . —.

Column 3, line 37, after "Machine" insert — S.N. 591,444 —.

Column 4, line 2, "examplary" should be — exemplary —.

Column 5, line 12, "bitmetallic" should be — bimetallic —.

Column 6, line 36, "extermeshed" should be — intermeshed —.

Column 7, line 9, "bimetalic" should be — bimetallic —.

Column 7, line 49, "entermeshed" should be — intermeshed —.

Column 8, line 3, "introduction" should be — introducing —.

Column 8, line 3, "asid" should be — said —.

Column 8, lines 25-26, after "vicinity" insert — of —.

UNITED STATES PATENT AND TRADEMARK OFFICE

CERTIFICATE OF CORRECTION

PATENT NO. : 5,141,407

DATED : August 25, 1992

INVENTOR(S) : Jeffery D. Ramsey; Jean-Luc Caillat; Sunil S. Kulkarni

It is certified that error appears in the above-identified patent and that said Letters Patent is hereby corrected as shown below:

Column 8, line 28, "valve" should be — passage —.

Column 8, line 30, "bimetalic" should be — bimetallic —.

Signed and Sealed this

Twenty-eight Day of February, 1995

*Attest:*

*Attesting Officer*

Bruce Lehman

BRUCE LEHMAN

*Commissioner of Patents and Trademarks*